US006527588B2

(12) United States Patent
Paagman

(10) Patent No.: US 6,527,588 B2
(45) **Date of Patent: *Mar. 4, 2003**

(54) ELECTRICAL CONNECTOR WITH INTEGRATED PCB ASSEMBLY

(75) Inventor: Bernardus L. F. Paagman, Schijndel (NL)

(73) Assignee: FCI Americas Technology, Inc., Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/777,773

(22) Filed: Feb. 6, 2001

(65) Prior Publication Data

US 2001/0010978 A1 Aug. 2, 2001

Related U.S. Application Data

(63) Continuation of application No. 08/784,744, filed on Jan. 16, 1997, now Pat. No. 6,183,301.

(51) Int. Cl.[7] ..... H01R 13/648
(52) U.S. Cl. ..... 439/608; 439/79
(58) Field of Search ..... 439/79, 80, 65, 439/608

(56) References Cited

U.S. PATENT DOCUMENTS

| | | | | |
|---|---|---|---|---|
| 2,844,807 A | | 7/1958 | McMilkin | 439/58 |
| 3,264,525 A | | 8/1966 | Swengel et al. | |
| 3,278,884 A | | 10/1966 | Bottlik | 439/74 |
| 3,971,610 A | | 7/1976 | Buchoff et al. | 439/76 |
| 4,338,717 A | | 7/1982 | Damon | 439/72 |
| 4,571,014 A | * | 2/1986 | Robin | |
| 4,600,256 A | | 7/1986 | Antilla | 439/65 |
| 4,678,250 A | | 7/1987 | Romine et al. | 439/876 |
| 4,764,122 A | | 8/1988 | Sorel | 439/66 |
| 4,806,107 A | | 2/1989 | Arnold et al. | 439/79 |
| 4,826,442 A | | 5/1989 | Douty | 439/83 |
| 4,836,791 A | | 6/1989 | Grabbe | 439/79 |
| 4,861,272 A | | 8/1989 | Clark | 439/79 |
| 4,993,957 A | | 2/1991 | Shino | 439/86 |
| 5,024,607 A | | 6/1991 | Kachlic | 439/587 |
| 5,060,369 A | | 10/1991 | Dale | 29/83 |
| 5,066,236 A | | 11/1991 | Broeksteeg | 439/79 |

(List continued on next page.)

FOREIGN PATENT DOCUMENTS

| | | |
|---|---|---|
| EP | 0 591 772 A1 | 9/1993 |
| EP | 0 627 788 A1 | 12/1994 |
| EP | 0 752 739 A1 | 7/1995 |
| JP | 2-78165 | 3/1990 |
| WO | WO 96/42123 | 6/1996 |
| WO | WO 97/02627 | 7/1996 |

OTHER PUBLICATIONS

IBM Technical Disclosure, Calloway et al., vol. 8, No. 3, p. 351, Aug. 1995.

Solving Problems with Elastomeric Connectors, 903 Machine Design, vol. 55, Nov. 1983, No. 27, Cleveland, Ohio USA.

Teka Advertisement Page, New SMT Connectors, Interplex Industries, Aug. 1986.

*Primary Examiner*—Neil Abrams
(74) *Attorney, Agent, or Firm*—M. Richard Page; Steven M. Reiss

(57) ABSTRACT

An electrical connector, comprising: a housing; and a plurality of modules received in said housing. Each module comprises: a printed circuit board assembly; and a plurality of contact secured to ends of traces located on outer surfaces of the printed circuit board assembly. The printed circuit board assembly also includes at least one shield layer located between the outer surfaces. A first group of the contacts engage a mating electrical component, and a second group of the contacts engage a circuit board to which the electrical connector mounts.

19 Claims, 4 Drawing Sheets

U.S. PATENT DOCUMENTS

| | | | | |
|---|---|---|---|---|
| 5,118,300 | A | | 6/1992 | Zarreli ..... 439/79 |
| 5,174,770 | A | | 12/1992 | Sasaki ..... 439/108 |
| 5,244,395 | A | | 9/1993 | DeSantis et al. ..... 439/65 |
| 5,383,095 | A | | 1/1995 | Korunsky et al. ..... 361/783 |
| 5,454,738 | A | | 10/1995 | Lim et al. ..... 439/676 |
| 5,470,244 | A | | 11/1995 | Lim et al. ..... 439/189 |
| 5,514,907 | A | | 5/1996 | Moshayedi ..... 361/760 |
| 5,522,727 | A | | 6/1996 | Saito et al. ..... 439/65 |
| 5,549,481 | A | | 8/1996 | Morlion et al. ..... 439/608 |
| 5,571,034 | A | | 11/1996 | Seidler ..... 439/876 |
| 5,588,849 | A | | 12/1996 | Kile ..... 439/78 |
| 5,593,322 | A | | 1/1997 | Swamy et al. ..... 439/660 |
| 5,605,477 | A | | 2/1997 | Wu ..... 439/620 |
| 5,702,258 | A | * | 12/1997 | Provencher et al. ..... 439/608 |
| 6,083,047 | A | * | 7/2000 | Paagman ..... 439/608 |
| 6,305,848 | B1 | * | 10/2001 | Gregory ..... 385/53 |

* cited by examiner

ELECTRICAL CONNECTOR WITH INTEGRATED PCB ASSEMBLY

CROSS-REFERENCE TO RELATED APPLICATIONS

This application is a continuation of U.S. patent application Ser. No. 08/784,744, filed on Jan. 16, 1997 and now U.S. Pat. No. 6,183,301, herein incorporated by reference.

BACKGROUND OF THE INVENTION

1. Field of the Invention

The present invention relates to electrical connectors. More specifically, the present invention relates to high speed, shielded electrical connectors having one or more integrated PCB assemblies.

2. Brief Description of Earlier Developments

U.S. Pat. No. 4,571,014 shows an approach for the manufacturing of backplane connectors using one or more PCB assemblies. Each of the PCB assemblies comprises one insulated substrate, one spacer, and one cover plate, all of which are attached to one another. The insulating substrate is provided with a predetermined pattern of conducting tracks, while ground tracks are provided between the conducting tracks. The conducting tracks are connected at one end to a female contact terminal for connection to the backplane and at the other end to a male through-hole contact terminal.

PCT Patent Application Serial No. US96/11214 filed Jul. 2, 1996 also discloses connectors employing side-by-side circuit substrates. The connectors disclosed in that application also employ through-hole terminals to make a mechanically and electrically secure connection to the circuit board on which the connector is to be mounted. The disclosure of the above-mentioned application is incorporated herein by reference.

While both of the above-mentioned connector arrangements can yield useful interconnection systems, many manufacturers of electronic equipment prefer to surface mount components on printed circuit boards. Surface mounting provides enhanced opportunities for miniaturization and the potential for mounting components on both sides of the circuit board.

SUMMARY OF THE INVENTION

It is an object of the present invention to provide high speed electrical connectors with one or more integrated PCB assemblies.

It is a further object of the present invention to provide electrical connectors having relatively low manufacturing costs.

These and other objects of the present invention are achieved in one aspect of the present invention by an electrical connector, comprising: a housing; and a plurality of modules received in said housing. Each module comprises: a printed circuit board assembly; and a plurality of contact secured to ends of traces located on outer surfaces of the printed circuit board assembly. The printed circuit board assembly also includes at least one shield layer located between the outer surfaces. A first group of the contacts engage a mating electrical component, and a second group of the contacts engage a circuit board to which the electrical connector mounts.

These and other objects of the present invention are achieved in another aspect of the present invention by a right angle receptacle, comprising: a housing; and a plurality of modules received in the housing. Each module comprises: a printed circuit board assembly and a plurality of contacts secured to traces located on outer surfaces of the printed circuit board assembly. The printed circuit board assembly also has: a first edge locatable adjacent a mating connector; a second edge locatable adjacent a circuit board to which the receptacle mounts; and at least one shield layer between said outer surfaces. A first group of contacts are located at the first edge and engage the mating connector. A second group of contacts are located at said second edge and engage the circuit board.

BRIEF DESCRIPTION OF THE DRAWINGS

Other uses and advantages of the present invention will become apparent to those skilled in the art upon reference to the specification and the drawings, in which.

DETAILED DESCRIPTION OF THE PREFERRED EMBODIMENTS

It is to be understood that, although the figures illustrate right angle connectors, the principles of the present invention equally apply to other connector configurations.

Electronic components E, such as resistors, capacitors and inductors, could be associated with the traces 16, 18 on PCB 10 for filtering purposes. These filtering elements could be easily incorporated into the PCB 10 using known manufacturing processes, such as thin film techniques.

Figure 1A:
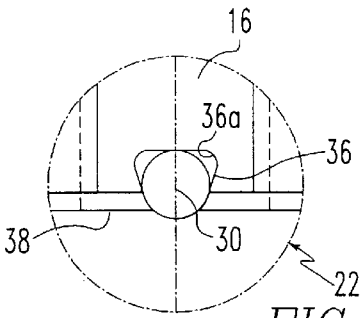
FIG. 1*a* is an enlargement of the circled area of FIG. 1.
Figure 1:
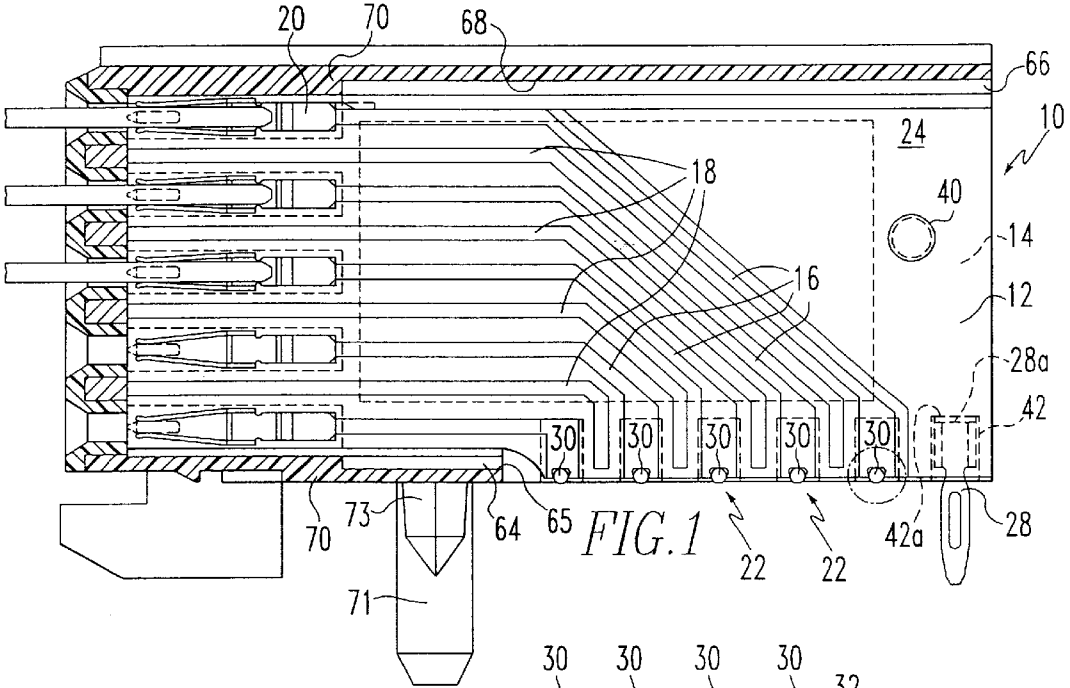
FIG. 1 shows in partial cross-section a connector illustrating the principles of the present invention.

Referring to FIG. 1, the PCB assembly 10 comprises an insulating substrate 12 of a material commonly commercially used for making PCBs. The substrate 12 can be a substantially planar resin impregnated fiber assembly, such as is sold under the designation FR4, having a thickness 0.4 mm, for example.

On a first surface of the substrate 12, a plurality of circuit or signal traces 16 are formed by conventional PCB techniques. Each trace 16 extends from a first portion of the substrate 10, for example adjacent the front edge as shown in FIG. 1, to a second area or region of the substrate 10, such as the bottom edge as shown in FIG. 1. The traces 16 may include contact pads at one end adapted to have metal terminals secured to them, as by conventional surface mounting techniques using solder or welding.

A plurality of ground or shielding traces 18 may also be applied to the substrate 10. The shielding traces 18 may be disposed between each of the circuit traces 16 or between groups of such traces. A terminal, such as a contact terminal 20 is mounted at the first end of each trace 16. Board mounting terminals 22, described in greater detail below, are disposed at the second end of each circuit trace 16. An additional shielding or ground layer 24 may be applied to the remainder of the trace bearing side of substrate 12. A ground or shield terminal 28 is fixed onto the ground layer 24.

Electronic components, such as resistors, capacitors and inductors, could be associated with the traces 16, 18 on PCB 10 for filtering purposes. These filtering elements could be easily incorporated into the PCB 10 using known manufacturing processes, such as thin film techniques.

Figure 3:
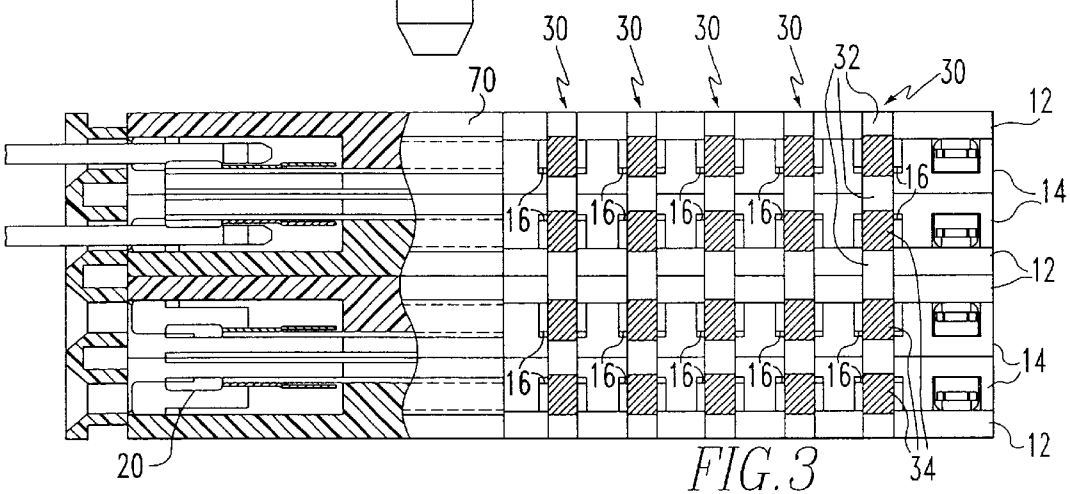
FIG. 3 is a partial bottom view of the connector shown in FIG. 1.

The contact structures 22 comprise surface mount terminals for electrically interconnecting each of the traces 16 with a circuit trace printed on the circuit substrate (not shown) onto which the connector is to be mounted. In a preferred arrangement, the contact structures 22 include a compressible or deformable element 30 formed of an elastomeric material. The element 30 may be circular in cross-section (as shown), D-shaped or another appropriate shape. The member 30 can be a continuous, elongated member that extends between several PCB modules, as shown (in FIG. 3), along aligned edges. In this case, the member has alternating non-conductive regions 32 and conductive regions 34, which can be formed by metallized coatings. The conductive regions are generally aligned with the centerlines of the contacts 20. In this manner, the row pitch of the connector at the mating interface is carried through to the contact pitch at the mounting interface.

Figure 4:
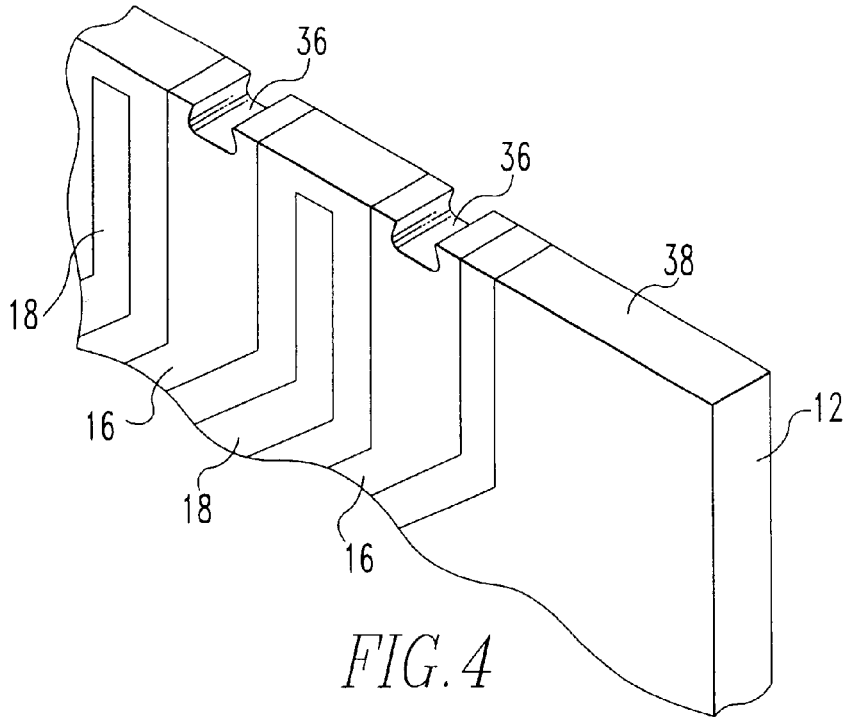
FIG. 4 is a partial isometric view of a PCB assembly according to the invention.
Figure 4A:
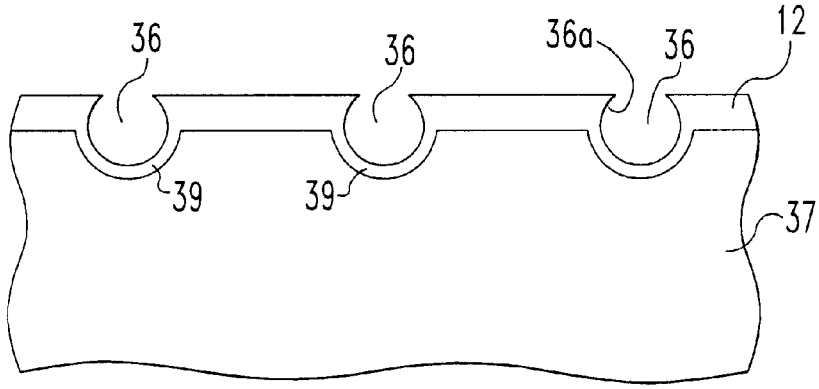
FIG. 4*a* is a fragmentary view of a PCB assembly having a shield layer on the obverse side of the PCB.

Along an edge 38 of the PCB 12 adjacent the ends of tracks 16, are suitably shaped recesses or notches 36, that may, for example, have a trapezoidal form as in FIG. 1*a* or a circular form, as shown in FIG. 4*a*. The compressible member 30 is received in and retained, as by a push fit, in the notches 36 with a portion extending beyond edge 38. This arrangement provides a mounting interface with good coplanarity. The inside surfaces 36*a* of each notch 36 are metallized, preferable by a coating that is continuous with the circuit trace 16.

If a shield or ground layer 37 (FIG. 4*a*) is present on the obverse side of PCB 12, the shield should be spaced from the notch 36, so that the notch remains electrically isolated from the shield layer, as is shown in more detail below. The covers 14 are similarly notched to accept the compressible member 30. The conductive sections 34 are arranged so that one end portion extends into the notch 36 and is in electrical contact with the plating on the interior surfaces 36*a* of the notch.

Each PCB module 10 preferable includes a hold-down for holding a connector formed from a plurality of such modules on a circuit substrate. In FIG. 1, the press-fit terminal 28 comprises such a hold-down. As well, the location peg 71 and hold-down pegs 73 of the housing 70 can be utilized to provide hold down or board retention functions. When the connector is pressed onto the receiving circuit substrate and the terminals 28 are pressed into holes on the circuit substrate, the portion of each element 30 extending beyond edge 38 is compressed. This compression creates normal forces that press the conductive portions 34 against the conductive traces on the mounting substrate and the surfaces 36*a* of the notches. As a result, a secure electrical connection is made between signal traces 16 and corresponding circuit traces on the mounting substrate.

The compressible members 30 can also comprise metallic elements, for example, elastically deformable spring contacts or non-elastically deformable metal contacts. Further, the compressible members 30 can comprise individual conductive elements, each one being associated with one of the notches 36. For example, the member 30 may comprise an elastically deformable, conductive spherical element or a heat deformable element, such as a solder ball (described below).

A locating hole 40 may be placed in the substrate 12. The locating hole 40 preferably comprises a plated through-hole for establishing electrical connection with a metallic shield layer 37 (see FIG. 4*a*) extending across the back surface of the substrate 12. As also previously described, small vias (not shown) forming plated through-holes may be disposed in each of the ground traces 18 so that the ground traces 18, the shield layer 24 and the back shield layer 37 form a shielding structure for the signal traces 16 and associated terminals.

As shown in FIG. 1, contact terminals 20 are formed as a one-piece stamping and can comprise a dual beam, contact defining an insertion axis for a mating terminal, such as a pin from a pin header.

A terminal module 10 is formed by associating a PCB assembly 12 with a cover 14. The cover 14 and PCB 12 are configured and joined substantially in the same manner as described in the above-referenced PCT patent application. The terminals 28 are located in the contact recesses 42 in covers 14.

If the board mounting terminal 28 is of a type that is likely to have a relatively high axial insertion force applied to it as the terminal is pushed into a through hole on the mounting substrate, such as a press-fit terminal, the surface 42*a* (FIG. 1) of the recess 42 is advantageously located so that it bears against the upturned tang 28*a* of the terminal 28. As previously noted in the above-identified PCT application, this arrangement allows the insertion force applied to the connector to be transmitted to terminal 28 through cover 14 in a manner that minimizes shear stress on the connection between terminal 28 and PCB 12.

Figure 2:
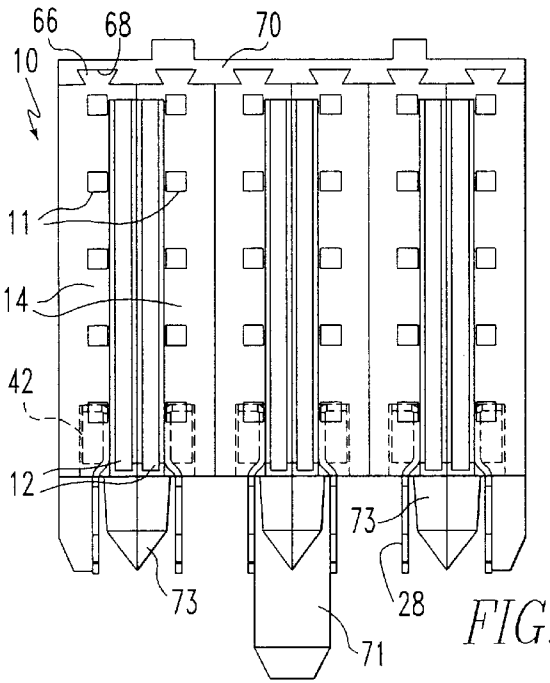
FIG. 2 shows a rear view of the connector shown in FIG. 1.

FIG. 2 shows a rear view of a connector comprising a molded plastic housing 70 and a plurality of PCB modules 10 in side-by-side relationship. In the connector shown in FIG. 2, the circuit boards 12 are located in back to back relationship, so that corresponding signal pairs (the location of which is shown schematically by small squares 11) can be arranged in twinax pairs. However, other shielded or non-shielded signal contact arrangements can be used. The PCB modules 10 are secured in housing 70, preferably by upper and lower dove tail ribs 66 and 64, respectively, formed in each of the covers 14. The ribs 66 and 64 are received in upper and lower dove tail grooves 68 and 65, respectively, formed on the inner top and bottom surfaces of housing 70.

As illustrated in FIG. 2, each circuit board includes a press fit terminal 28. The region of the bottom side of the connector at which the surface contact members 30 are located in flanked at one end by the retention pegs 73 and at the other by the press fit terminals 28, to ensure adequate compressive force for urging the members 30 against contact pads (not shown) on the mounting substrate.

FIG. 4 is an fragmentary isometric view of a rear bottom corner of PCB 12 before terminals or conductive elements are associated with notches 36. It shows signal traces 16 that terminate at an edge of the board 12. Recesses 36 are formed at the edge of the PCB 12 and the surfaces 36*a* of the recesses are plated, so that there is electrical continuity between traces 16 and recesses 36. Referring to FIG. 4*a*, if the PCB carries a shield layer 37 on the side opposite the side on which signal traces 16 and shield traces 18 are printed, the shield layer is spaced from recesses 36, for example, by the unplated regions 39.

Figure 6:
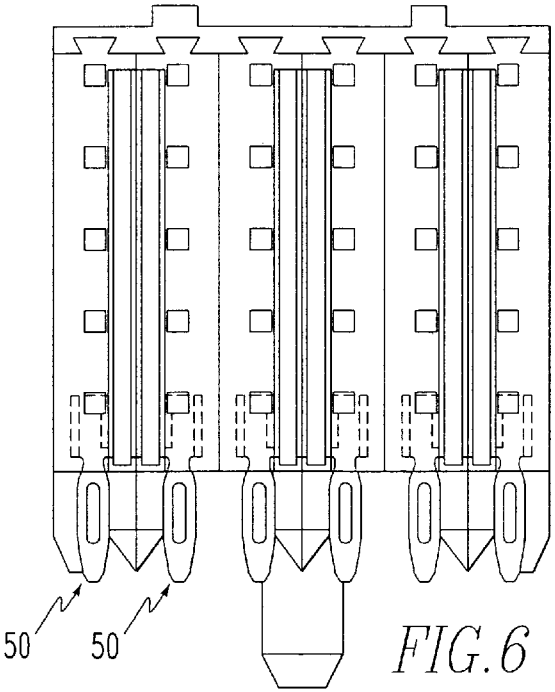
FIG. 6 is a rear view of the connector of FIG. 5.
Figure 5:
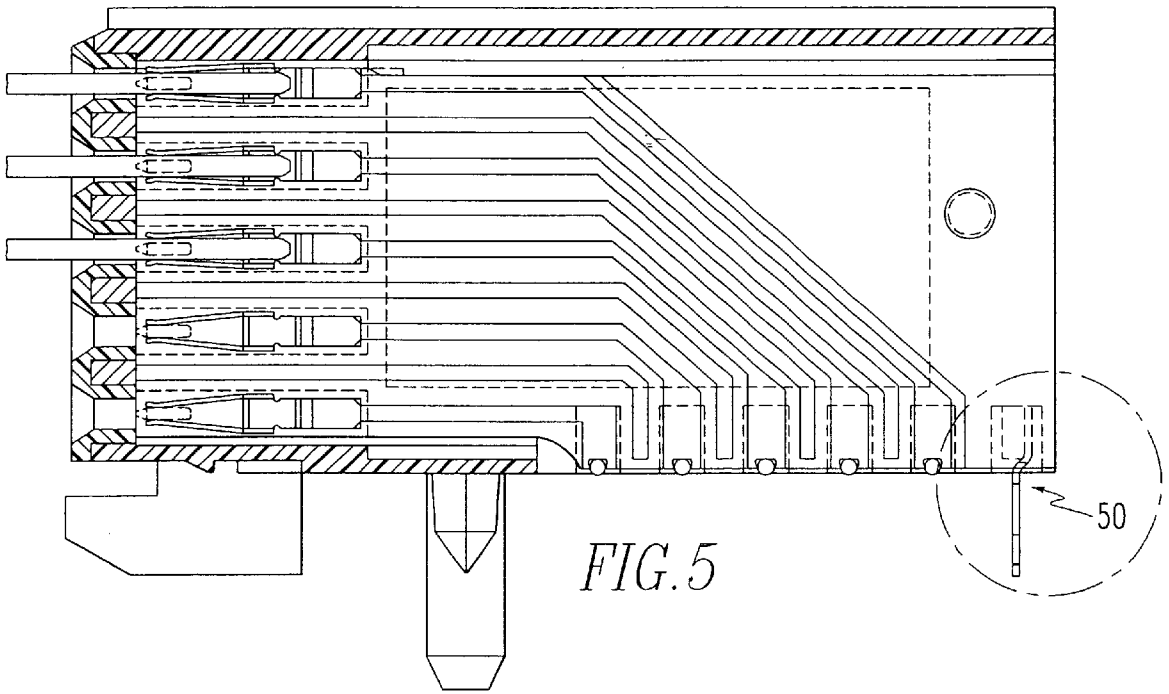
FIG. 5 is a partial cross-sectional view showing an alternative mounting of shield terminals on the PCB assembly of the connector shown in FIG. 1.
Figure 5A:
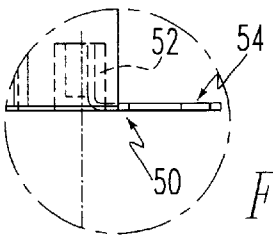
FIG. 5*a* is an illustration of the circled area in FIG. 5 with the shield/hold down terminal in an actual surface mount orientation.
Figure 7:
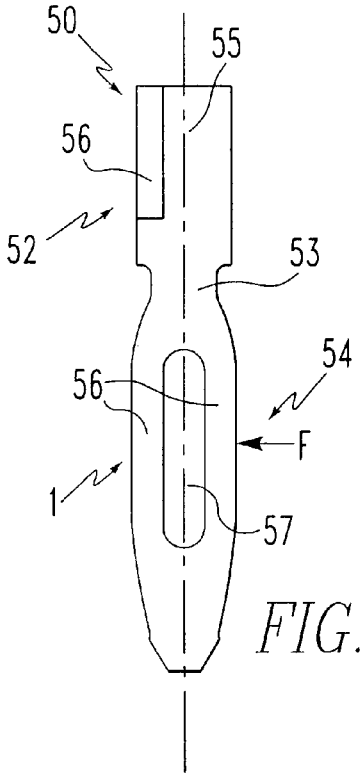
FIG. 7 is a front view of a hold down terminal used with the connector in FIG. 5.
Figure 8:
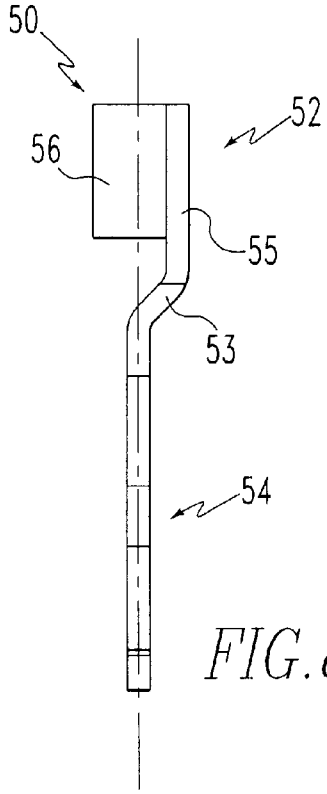
FIG. 8 is a side view of the hold down terminal shown in FIG. 7.

FIG. 5 shows a partial cross-sectional view of a connector having a convertible form of hold-down terminal 50. FIGS. 5 and 6 show the terminal 50 positioned for press fitting into a mounting substrate and FIG. 5*a* shows how the terminal is positioned for surfacing mounting by being bent 90°. The terminals 50, shown in greater detail in FIGS. 7 and 8, have a mounting section 52 and compliant through-hole sections 54.

The mounting section 52 includes a base 55 and a solder tab 56 disposed in substantially a right angle relationship with base 55. The mounting section 52 is joined to the compliant sections 54 by a reduced width neck section 53.

The compliant section 54 comprises a pair of legs 58 that are movable inwardly when forces in the compliance direction of arrows F are imparted to legs 58 as it is inserted in a through-hole. As is known, elastic deformation of legs 58 creates a normal force that in turn creates a frictional force that opposes movement in the direction of the longitudinal axis of terminal 50 for retaining the terminal in a through-hole.

Each terminal 50 is mounted on an associated PCB by solder tab 56. Such mounting positions the planes of base 55 and compliant section 54 substantially transverse to the plane of the PCB. If the angle between base 52 and solder tab 56 is 90°, then the planes of base 52 and compliant section 54 will be substantially normal to the plane of PCB 12.

An advantage of this positioning is that the terminal can readily be converted to a surface mount terminal by bending the section 54 with respect to the base section 52 in the region of neck 53 as shown in FIG. 5*a*. As a result, the section 54 can be bent 90° to be positioned substantially parallel to the surface of the circuit board to which the connector is mounted. This places the compliant section 54 in an orientation to be surface mounted on the connector-receiving circuit board. A strong solder attachment can be made because the solder meniscus can extend along and through the opening 57.

Another advantage of the terminal 50 is that it can be used as normal press fit terminals by soldering the base 55 onto the PCB 12, to position the compliant section 54 in the same orientation as terminal 28 shown in FIGS. 1 and 2. In this orientation the tab 56 functions in the same manner as tab 28*a* (FIG. 1) to take the axial force applied to the terminals during board insertion.

Figure 9:
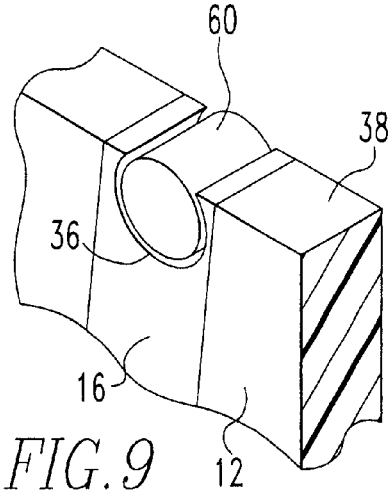
FIG. 9 illustrates a second form of mounting interface terminal.

In the foregoing description, the mounting interface terminals 22 have been described principally as elements that are deformable upon the application of force. The terminals 22 (FIG. 1) can also comprise elements that are deformable upon the application of heat. In this regard, FIG. 9 illustrates an embodiment wherein the conductive recesses or notches 36 in edge 38 of PCB 12 receive a heat deformable element 60.

The element 60 as shown is a generally cylinderical body of solder. Alternatively, the body 60 may be other shapes, for example, a spherical solder ball. The element 60 can be retained in recess 36 by a snap or friction fit, by solder paste, or by fusing the element 60 into notch 36, as by a reflow operation. An advantage of this embodiment is that connectors using this form of terminal at the mounting interface can be mounted without the need for a hold down arrangement that must maintain compressive forces, as in the previously described embodiment.

The term "surface mount" when used in the specification and claims with respect to the board mounting terminals or contacts 22 is meant to connect the absence of a through-hole type of connection and is not meant to refer solely to interconnections using solder or solder paste.

The foregoing constructions yield connectors with excellent high speed characteristics at low manufacturing costs. Although the preferred embodiment is illustrated in the context of a right angle connector, the invention is not so limited and the techniques disclosed in this application can be utilized for many types of high density connectors systems wherein signal contact are arranged in rows and columns.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector, comprising:

a housing; and a plurality of modules received in said housing, each module comprising:

a printed circuit board assembly contained substantially within said housing, having:

outer surfaces with continuous surface traces thereon; and at least one shield layer between said outer surfaces; and a plurality of contacts secured to ends of said traces;

wherein a first group of said contacts are adapted to engage a mating electrical component and a second group of said contacts are adapted to engage a circuit board to which the electrical connector mounts, said printed circuit board oriented perpendicular with respect to said circuit board to which the electrical connector mounts.

2. The electrical connector as recited in claim 1, wherein said at least one shield layer comprises two shield layers.

3. The electrical connector as recited in claim 1, wherein at least some of said contacts surface mount to said traces.

4. The electrical connector as recited in claim 1, having at least one press-fit contact.

5. The electrical connector as recited in claim 1, wherein said traces on one of said outer surfaces are mirror images of said traces on the other of said outer surfaces for twin-ax pairing.

6. The electrical connector as recited in claim 1, wherein said housing includes passageways therein for receiving said modules.

7. The electrical connector as recited in claim 6, wherein each module includes at least one dove-tail element for reception into a corresponding passageway in said housing.

8. The electrical connector as recited in claim 1, wherein the connector is a right angle receptacle connector.

9. The electrical connector as recited in claim 1, further comprising an electrical component associated with said traces.

10. The electrical connector as recited in claim 9, wherein said electrical component comprises a resistor, a capacitor or an inductor.

11. The electrical connector as recited in claim 1, wherein said printed circuit board assembly comprises two adjacently located printed circuit boards.

12. A right angle receptacle, comprising:

a housing; and a plurality of modules received in said housing, each module comprising:

a printed circuit board assembly contained substantially within said housing, having:

a first edge locatable adjacent a mating connector;

a second edge locatable adjacent a circuit board to which the receptacle mounts;

outer surfaces with traces thereon, said traces extending between said first and second edges; and at least one shield layer between said outer surfaces; and a plurality of contacts secured to said traces;

wherein a first group of said contacts are located at said first edge for engaging the mating connector and a second group of said contacts are located at said second edge to engage the circuit board.

13. The receptacle as recited in claim 12, wherein said at least one shield layer comprises two shield layers.

14. The receptacle as recited in claim 12, wherein at least some of said contacts surface mount to said traces.

15. The receptacle as recited in claim 12, wherein said traces on one of said outer surfaces are mirror images of said traces on the other of said outer surfaces for twin-ax pairing.

16. The receptacle as recited in claim 12, wherein said housing includes passageways therein for receiving said modules.

17. The receptacle as recited in claim 16, wherein each module includes at least one dove-tail element for reception into a corresponding passageway in said housing.

18. The receptacle as recited in claim 12, further comprising an electrical component associated with said traces.

19. The receptacle as recited in claim 18, wherein said electrical component comprises a resistor, a capacitor or an inductor.

* * * * *